US007097039B2

(12) United States Patent
Muis et al.

(10) Patent No.: US 7,097,039 B2
(45) Date of Patent: Aug. 29, 2006

(54) SINGLE TACO TRAP AND HOLDER

(76) Inventors: Robert Chris Muis, 2442 S. Ridge Ave., Bullhead City, AZ (US) 86429; Susanne Muis, 2442 S. Ridge Ave., Bullhead City, AZ (US) 86429

( * ) Notice: Subject to any disclaimer, the term of this patent is extended or adjusted under 35 U.S.C. 154(b) by 105 days.

(21) Appl. No.: 10/368,077

(22) Filed: Feb. 20, 2003

(65) Prior Publication Data

US 2004/0163992 A1 Aug. 26, 2004

(51) Int. Cl.
*B65D 1/34* (2006.01)

(52) U.S. Cl. ..... 206/564

(58) Field of Classification Search ..... 206/557, 206/561, 564, 566, 271, 273, 147, 175, 187, 206/188, 189, 190, 193, 353, 750, 562; 211/85, 211/85.4

See application file for complete search history.

(56) References Cited

U.S. PATENT DOCUMENTS 1,445,124 A * 2/1923 Ames ..... 206/353
3,083,825 A * 4/1963 Larsen ..... 206/434
4,509,674 A * 4/1985 Levick ..... 229/122.21
4,603,825 A * 8/1986 Kotliar ..... 248/174
4,653,645 A * 3/1987 Thomas ..... 206/549
4,671,404 A * 6/1987 Wall et al. ..... 248/150
4,746,010 A 5/1988 Fournier
4,872,566 A 10/1989 Alsup
4,925,032 A 5/1990 Liles
5,005,704 A 4/1991 Martin
5,203,493 A * 4/1993 Moody ..... 229/103
5,297,673 A * 3/1994 Sutherland ..... 206/147
5,323,895 A * 6/1994 Sutherland et al. ..... 206/147
5,335,774 A * 8/1994 Ganz ..... 206/153
5,971,168 A 10/1999 Proulx
5,979,656 A * 11/1999 Northcott et al. ..... 206/564
6,019,224 A * 2/2000 Rich ..... 206/546
6,273,278 B1 8/2001 Enyedy

* cited by examiner

*Primary Examiner*—Kurt Fernstrom

(57) ABSTRACT

A disposable single trap and holder for tacos and the like comprised of semi-rigid flat material to accommodate the ability of the holder to be efficiently packaged in a retail container. The holder has a flat circle shaped configuration with specific cuts and lines of weakness, whereas, when pressed outward from center, the holder will form first and second side walls extending from a generally horizontal base portion to accommodate and support a taco and the like in an upright position.

9 Claims, 3 Drawing Sheets

SINGLE TACO TRAP AND HOLDER

FIELD OF THE INVENTION

This invention relates generally to a disposable trap and holder to support one taco per holder and the like that is suitable for mass production and inclusion in packaging for public restaurants and consumer use.

BACKGROUND OF THE INVENTION

In providing a taco holder for inclusion in public restaurants and consumer use, among the considerations that must be addressed are the ease of assembly and use by the consumer: the efficiency for holding a taco in an upright position, to serve and the like without spillage or breakage during filling and possibly heating; the ability to hold a taco and the like for individaulized servings; and the ability of the holder to be efficiently packaged in a retail container.

DESCRIPTION OF THE PRIOR ART

The disadvantages with some holders, besides being too expensive and structually complex in design, are the difficulties for the consumer to assemble the device and the inadequacy to facilitate packaging in a retail container.

In the past, efforts have been made toward mastering an inexpensive, disposable holder that is both structurally adequate and easy to package in a retail container.

For example, U.S. Pat. Nos. 6,273,278 and 5,971,168 disclose a holder for multiple taco shells, which is disposable, and can be maintained in a flat position prior to use.

U.S. Pat. No. 4,746,010 discloses a taco tray, which is made by converting the retail container that is used to package food items, such as taco shells.

U.S. Pat. Nos. 5,005,704, 4,925,032, and 4,872,566 disclose a holder for single taco shells, which is disposable, and can be maintained in a flat position prior to use.

The disadvantages of prior designs as those disclosed in the '278, '168, '010, '704, '032, and '566 patents are the difficulties of assembling the taco holders and the structural complexity to economically manufacture such designs. The design disclosed in the '278 patent requires the bottom wall folds in on itself so that the holder may be shifted to a rise position by unfolding and flattening the bottom wall. The design disclosed in the '168 patent requires that in conjunction with forming several folds, several tabs and slots or glue strips must be employed in order to create the finished holder. The '010 patent requires that several perforated sections be removed from the box in order to form the taco holder, thus can no longer provide a means to store remaining unused product. The '704, '032, and '566 patents, even though being single taco holders, once again, require that in conjunction with forming several folds, several tabs and slots or glue strips must be employed in order to create the finished holder.

It can be seen that the present invention is an improvement over these prior-art taco holders by providing a simple, easy to assemble, cost efficient taco holder, which can be disposable and meets the criteria desired for such devices.

SUMMARY OF THE INVENTION

Accordingly, it is an object that the present invention provide a single holder for a taco and the like comprised of semi-rigid flat material structurally adequate to support a taco and the like in an upright position and which is also inexpensive to make, easy to assemble, and maintains a flat position prior to use for incorporation into a retail container. The taco trap and holder preferably comprises a base portion and a centrally located pair of side structures defining an open slot for receiving a taco and the like when folded outward at center. The center portion of the taco trap and holder may contain a plurality of lines punched therein with two peripheral lines of weakness so that the holder may be maintained in a flat position prior to use.

The above object and advantages of this invention are pointed out with particularity in the claims and annexed hereto and forming a part hereof. However, for a better understanding of the invention, the advantages, and the objects obtained by its use, the following drawings which form a further part hereof, should be referenced in which there is illustrated and described preferred embodiments of the invention.

BRIEF DESCRIPTION OF THE DRAWINGS

The accompanying drawings, which are incorporated in and form a part of the specification, illustrate the preferred embodiment of the present invention, and together with the descriptions, serve to explain the principles of the invention.

FIG. 5 is a perspective view of a taco trap and holder depicting the device in its entirety accompanied by the product it was invented for.

DETAILED DESCRIPTION OF THE PREFERRED EMBODIMENT

Figure 1:
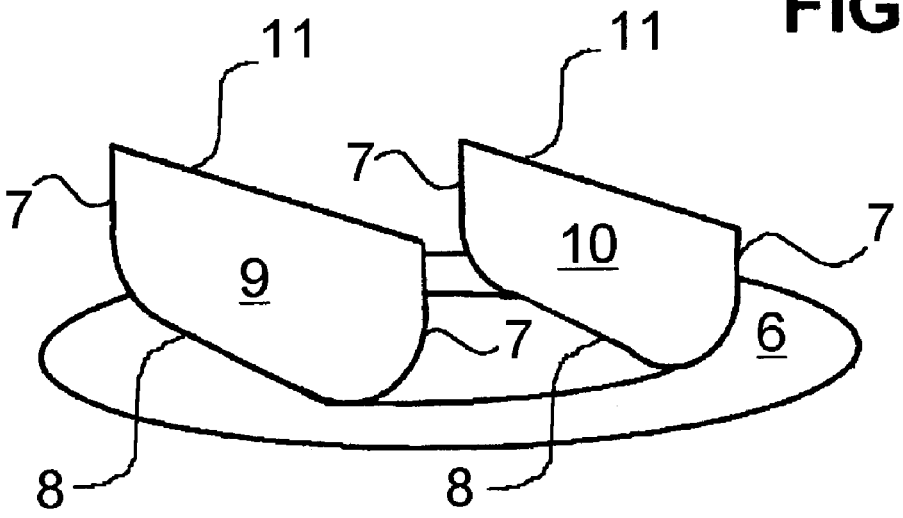
FIG. 1 is a perspective view of an assembled taco trap and holder in accordance with a second embodiment of the invention.

As shown in the drawings for purposes of illustration, the invention is preferably embodied in a holder 6 formed of semi-rigid material. Virtually any semi-rigid material may be suitable to practice the invention; examples of such materials are various grades of paper or paperboard approved for direct food contact, including, but not limited to, solid bleached sulfate, solid unbleached sulfate, recycled paperboard, unbleached craft chipboard, or combinations of these or other materials. In a preferred embodiment, a recyclable, bleached paperboard with a polymer based coating is used to manufacture the invention.

Several types of plastic approved for direct food contact may be utilized for such coating.

In a preferred embodiment of the invention, a polyethylene coating is used. Although materials of various thicknesses would be appropriate to practice the invention, in a preferred embodiment the thickness of the paperboard varies between about 1/16 inch to about 1/8 inch.

To achieve adequate stiffness, the thickness of the material should be a minimum of about 1/16 inch.

Figure 2:
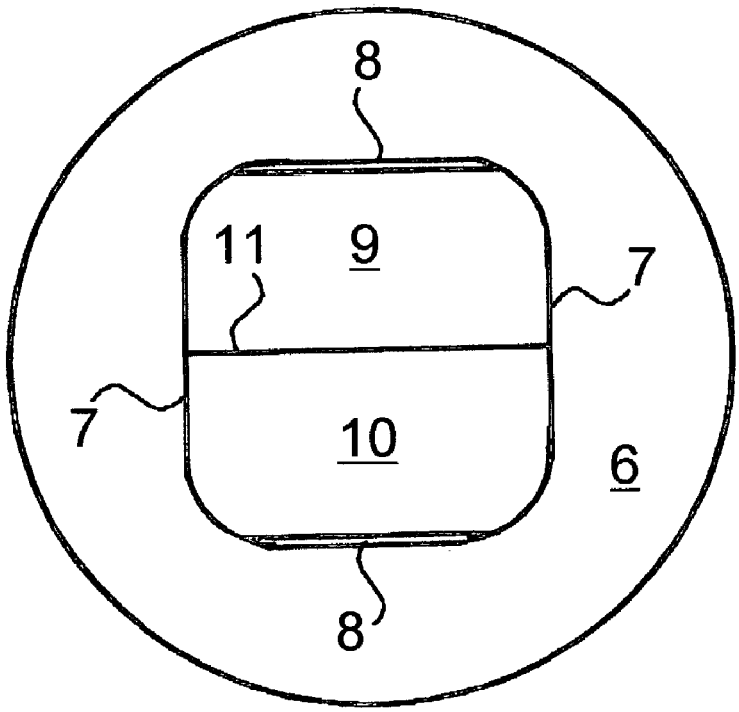
FIG. 2 is a top view of a taco trap and holder blank in accordance with a first embodiment of the invention.
Figure 3:
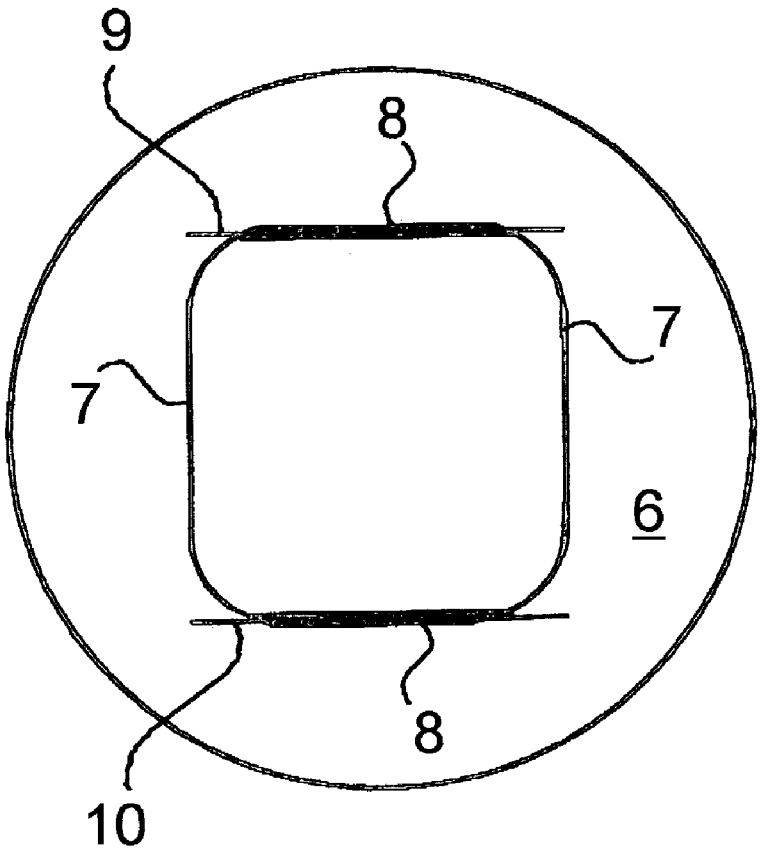
FIG. 3 is a top view of a taco trap and holder in accordance with a second embodiment of the invention.
Figure 4:
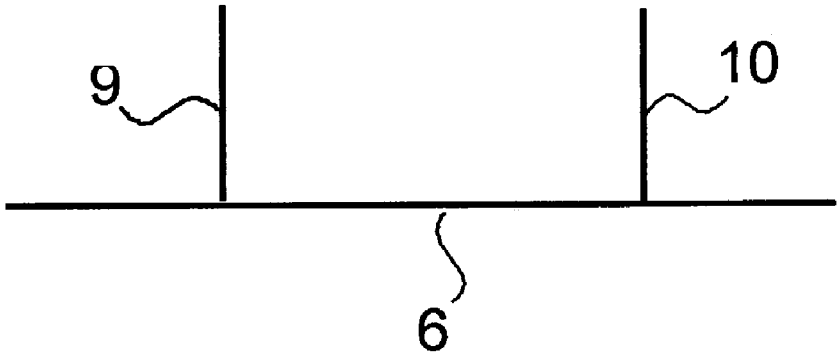
FIG. 4 is a side view of a taco trap and holder in accordance with a second embodiment of the invention.
Figure 5:
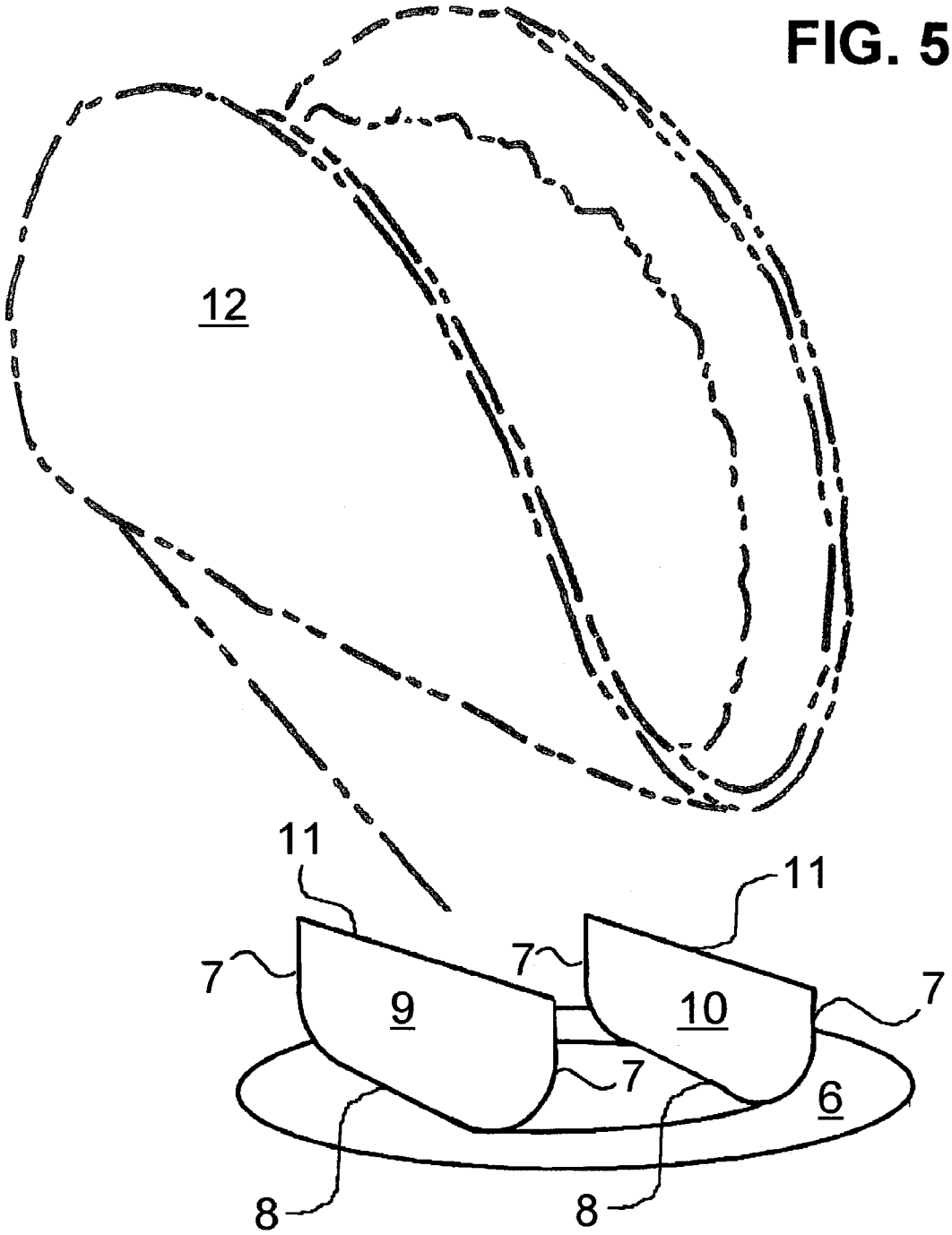

A circular blank for the taco trap and holder in accordance with a first embodiment is drawn approximately 125% in size in FIG. 2.

Although the size of the food article to be placed in the holder may vary in thickness slightly, the dimensions of the preferred embodiment 6 of each unassembled blank is 2½to 3 inches in diameter. A plurality of lines 7 punched therein with two peripheral lines 8 of weakness provides a means to fold outwardly a pair of adequately spaced, first 9 and second 10 side walls, to accommodate and support a taco and the like in an upright position.

As to assemble the taco trap and holder from the blank in FIG. 2, the central lines 7 and 11 punched therein are situated along the longitudinal axis of the blank and parallel to each other from center of blank along lines of weakness 8. The displacement of the side walls 9 and 10 may be folded backward to maintain an upright position.

To assemble the taco trap and holder from the blank of FIG. 2, folds are made along the lines of weakness 8.

The central 11 and side cut edges 7 form the walls of the holder with the peripheral lines of weakness 8 situated at opposing sides of the base 6.

Once the holder is assembled and the side walls 9 and 10 are in an upright position, the apertures provide a means for holding a taco 12 and the like in place.

What is claimed is:

1. A blank for assembly into a holder for a taco and the like comprising:

a) a substantially flat symmetrical device formed of semi-rigid material;

b) a central longitudinal cut line;

c) first and second cut lines transverse on opposing ends of said central longitudinal cut line;

d) first and second lines of weakness being parallel to and on opposing sides of said central longitudinal cut line;

e) first and second side walls, configured so that when said blank is pressed outward along said longitudinal and said first and second transverse cut lines, said flat circle shaped object forms substantially perpendicular said first and second side walls extending therefrom.

2. A blank for assembly into a holder for a taco and the like as in claim 1, wherein said blank is comprised of a substantially flat oval shaped device formed of semi-rigid material.

3. A blank for assembly into a holder for a taco and the like as in claim 1, wherein said blank is comprised of a substantially flat square shaped device formed of semi-rigid material.

4. A blank for assembly into a holder for a taco and the like as in claim 1, wherein said blank is comprised of a substantially flat rectangular shaped device formed of a semi-rigid material.

5. A blank for assembly into a holder for a taco and the like as in claim 1, wherein said blank is comprised of a substantially flat circle shaped device with symmetrical points formed of semi-rigid material.

6. A blank for assembly into a holder for a taco and the like as in claim 1, wherein said blank is comprised of a substantially flat octagonal shaped device formed of semi-rigid material.

7. A blank for assembly into a holder for a taco and the like as in claim 1, wherein said central longitudinal cut line and first and second cut lines transverse on opposing ends of said central longitudinal cut line are perforated lines.

8. A blank for assembly into a holder for a taco and the like as in claim 1, wherein said first and second lines of weakness being parallel to and on opposing sides of said central longitudinal cut line are perforated lines.

9. A blank for assembly into a holder for a taco and the like as in claim 1, wherein said blank is comprised of a substantially flat circle shaped device formed of semi-rigid material.

* * * * *